US008784162B1

(12) United States Patent
Dovel

(10) Patent No.: US 8,784,162 B1
(45) Date of Patent: Jul. 22, 2014

(54) SHARPENER FOR CUTTING TOOLS

(75) Inventor: Daniel T. Dovel, Shady Cove, OR (US)

(73) Assignee: Professional Tool Manufacturing LLC, Ashland, OR (US)

( * ) Notice: Subject to any disclaimer, the term of this patent is extended or adjusted under 35 U.S.C. 154(b) by 999 days.

(21) Appl. No.: 12/490,794

(22) Filed: Jun. 24, 2009

Related U.S. Application Data

(60) Provisional application No. 61/076,435, filed on Jun. 27, 2008.

(51) Int. Cl.
*B24B 3/54* (2006.01)

(52) U.S. Cl.
USPC ..... 451/303; 451/311; 451/349; 451/355

(58) Field of Classification Search
USPC ..... 451/45, 59, 296, 303, 311, 344, 349, 451/355
See application file for complete search history.

(56) References Cited

U.S. PATENT DOCUMENTS

| | | | | | |
|---|---|---|---|---|---|
| 2,566,809 | A * | 9/1951 | Risley et al. | ..... | 451/311 |
| 2,852,895 | A * | 9/1958 | Lamison | ..... | 451/297 |
| 4,043,082 | A * | 8/1977 | Ferroglio | ..... | 451/311 |
| 4,368,597 | A * | 1/1983 | Fleckenstein | ..... | 451/355 |
| 4,443,977 | A * | 4/1984 | Gaiani | ..... | 451/309 |
| 4,617,763 | A * | 10/1986 | Edling | ..... | 451/302 |
| 4,642,943 | A * | 2/1987 | Taylor, Jr. | ..... | 451/296 |
| 4,964,241 | A * | 10/1990 | Conklin | ..... | 451/296 |
| 5,036,626 | A * | 8/1991 | Fuchs | ..... | 451/296 |
| 5,099,615 | A * | 3/1992 | Ruble et al. | ..... | 451/5 |
| 5,165,203 | A * | 11/1992 | Chuang | ..... | 451/297 |
| 5,443,415 | A * | 8/1995 | Shebanow et al. | ..... | 451/302 |
| 5,470,271 | A * | 11/1995 | Briggs et al. | ..... | 451/55 |
| 6,419,569 | B1 * | 7/2002 | Frech et al. | ..... | 451/355 |
| 7,025,666 | B1 * | 4/2006 | Wang | ..... | 451/296 |
| 7,374,470 | B2 * | 5/2008 | Fuchs | ..... | 451/5 |
| 2004/0018808 | A1 * | 1/2004 | Lin et al. | ..... | 451/311 |
| 2008/0017225 | A1 * | 1/2008 | Randhawa et al. | ..... | 134/140 |
| 2011/0009038 | A1 * | 1/2011 | Kishi et al. | ..... | 451/311 |

* cited by examiner

*Primary Examiner* — Eileen P. Morgan
(74) *Attorney, Agent, or Firm* — Hall Estill Attorneys at Law

(57) ABSTRACT

Various embodiments of the present invention are generally directed to an apparatus for sharpening a cutting tool. A tensioner assembly applies a biasing force to a roller to maintain a selected tension in a belt and to facilitate translational displacement of the roller during deflection of the belt. In some embodiments, the tensioner assembly includes a shaft with an L-shaped groove with an elongated portion and an offset portion to facilitate transition of the roller between an extended position and a retracted position. In related embodiments, the tensioner assembly comprises a shaft with an elongated groove to facilitate tracking alignment of the belt on the roller. In further related embodiments, a guide housing is provided adjacent an abrasive medium with a guide slot and magnet to facilitate presentation of a cutting tool against the abrasive medium.

20 Claims, 8 Drawing Sheets

SHARPENER FOR CUTTING TOOLS

RELATED APPLICATION

This application makes a claim of domestic priority under 35 U.S.C. §119(e) to U.S. Provisional Patent Application No. 61/076,435 filed Jun. 27, 2008.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors, have a first opposing surface that extends in a substantially normal direction, and a second opposing surface that is skewed with respect to the first surface.

More complex geometries can also be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, etc. A limitation with these and other prior art sharpening techniques, however, is the inability to precisely define the opposing surfaces at the desired angles to provide a precisely defined cutting edge.

SUMMARY

Various embodiments of the present invention are generally directed to an apparatus for sharpening a cutting tool.

In accordance with some embodiments, the apparatus generally comprises a tensioner assembly which applies a biasing force to a roller to maintain a selected tension in a belt and to facilitate translational displacement of the roller during deflection of the belt. The tensioner assembly includes a shaft with an L-shaped groove with an elongated portion and an offset portion, wherein in an extended position a guide member slidingly advances along the elongated portion relative to the shaft to facilitate said displacement of the roller. The roller is moved to a locked retracted position by sliding movement of the locking member relative to the shaft and angular rotation of the roller to place the locking member within the offset portion.

In accordance with further embodiments, the apparatus comprises a tensioner assembly which applies a biasing force to a roller to maintain a selected tension in a belt and to facilitate translational displacement of the roller during deflection of the belt. The tensioner assembly comprises a shaft with an elongated groove which extends in a first direction along an axial length of the shaft, and a guide member disposed in the elongated groove. Advancement of the guide member in a second direction induces axial rotation of the shaft to adjust a tracking alignment of the belt on the roller.

In accordance with still further embodiments, the apparatus comprises an abrasive medium and a guide housing. The guide housing includes a guide slot to facilitate presentation of a magnetically permeable tool against the abrasive medium. A magnet positioned adjacent the guide slot exerts a biasing force upon the tool that both draws the first tool against a guide surface of the guide slot and draws the tool into the guide slot along the guide surface to hold the tool at a neutral position at which a cutting edge of the first tool applies a contacting force against the abrasive medium.

These and other features and advantages associated with the various embodiments of the present invention can be understood from a review of the following detailed description and accompanying drawings.

DETAILED DESCRIPTION

Figure 1A:
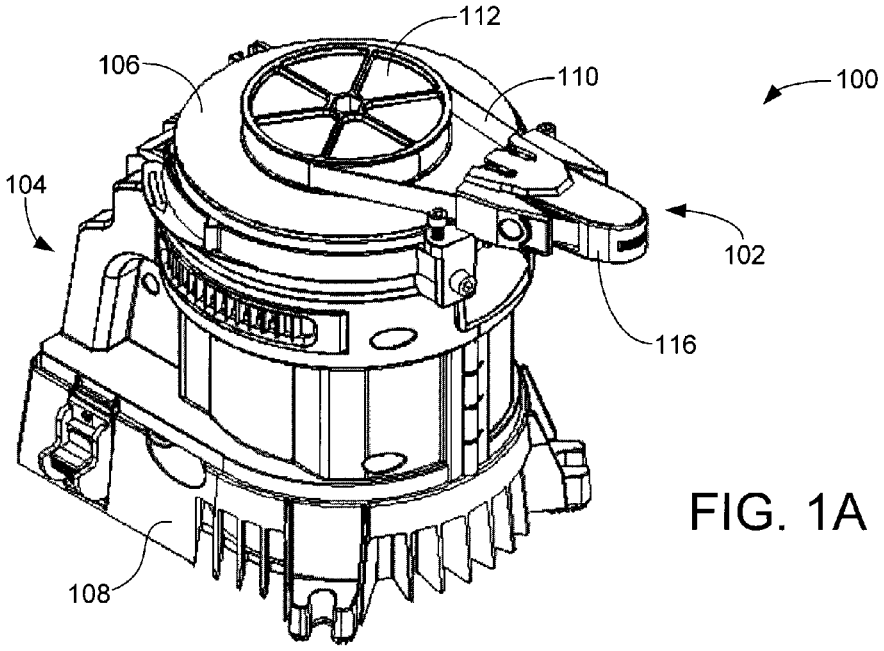
FIG. 1A is an isometric representation of a cutting tool sharpener system (sharpener) constructed in accordance with various embodiments of the present invention.

FIG. 1 shows an exemplary cutting tool sharpener system 100 constructed in accordance with various embodiments of the present invention. The system 100 preferably comprises an attachment characterized as a sharpener assembly 102, which is configured to be removably mounted to a base sharpener unit 104.

The base sharpener unit 104 is a stand-alone unit generally adapted to sharpen a number of different types of tools using a rotatable abrasive disc 106. The disc 106 is rotated via a drive assembly (not separately shown) disposed within a housing 108. The drive assembly preferably utilizes includes an electric motor which rotates at a selected rotational rate such as on the order of about 1750 revolutions per minute, rpm.

Bladed tools such as chisels, axes, woodworking tools, etc. can be advantageously sharpened by the unit 104 by presentation of the tools to respective upper or lower abrasive surfaces of the disc 106.

The sharpener assembly 102 is preferably configured to be removably attached to the unit 104 to provide additional tool sharpening configurations for a user. Unlike the unit 104, the assembly 102 utilizes one or more abrasive belts to facilitate a sharpening operation. The assembly 102 is preferably mounted above the abrasive disc 106 and powered by the drive assembly of the unit 104.

At this point it will be appreciated that, while the assembly 102 is characterized as an optional attachment for the unit 104, such is merely for purposes of illustrating a preferred embodiment of the present invention. It will be appreciated that the assembly 102 can be alternatively configured as a stand alone sharpener, such as in a handheld configuration, a tabletop version, etc.

Figure 1B:
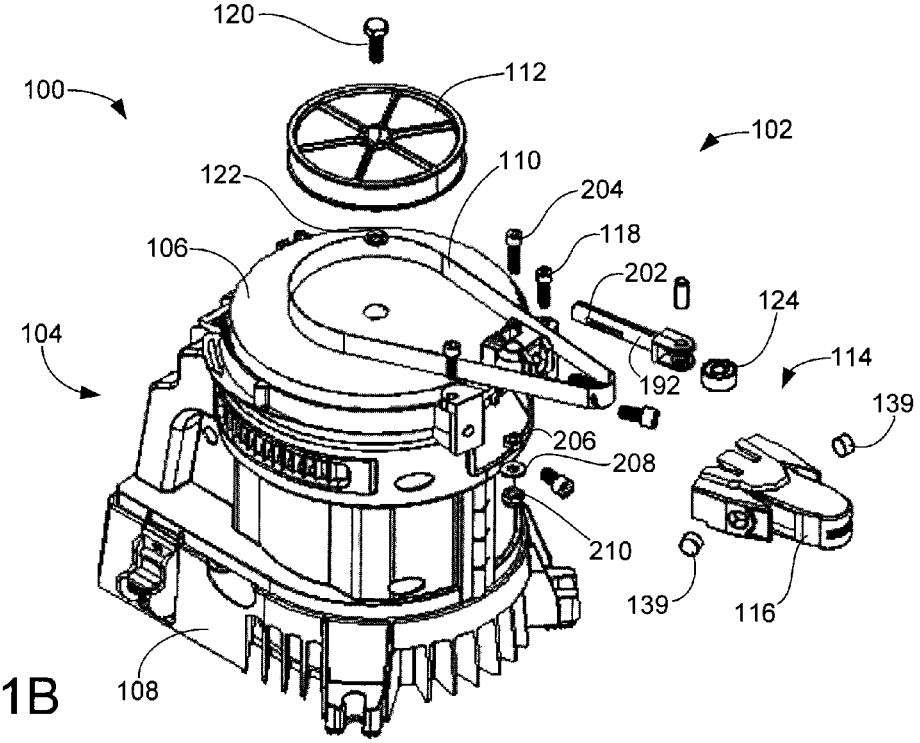
FIG. 1B shows a sharpener assembly attachment of FIG. 1A in an exploded fashion to reveal various components of interest.

FIG. 1B shows an exploded view of the assembly 102 to reveal various constituent components of interest. Preferred configuration and operation of these components will be discussed below, but for purposes of reference these components generally include a continuous abrasive belt 110, a drive pulley 112, a belt tensioner assembly (denoted generally at 114), and a guide housing 116. Various fasteners 118 connect and align the assembly 102 to the unit 104.

A fastener 120 and lower locking washer 122 combine to secure the drive pulley 112 to the drive assembly of the unit 104 during installation. While not shown, it will be appreciated that a separate fastener assembly, such as a user knob with a threaded fastener extending therefrom, is preferably used to normally secure the abrasive disc 106 to the unit 104.

To install the sharpener assembly 102, this separate fastener assembly is removed, the drive pulley 112 is placed onto the abrasive disc 106, and the fastener 120 is installed to secure the drive pulley 112 to the disc. In this way, the disc 106 serves as a spacer support for the drive pulley 112, but is otherwise not used during operation of the sharpener assembly 102. Alternatively, the disc 106 can be removed and a suitable spacer can be installed to place the pulley 112 at the same elevation as if the disc 106 were present.

Figure 2:
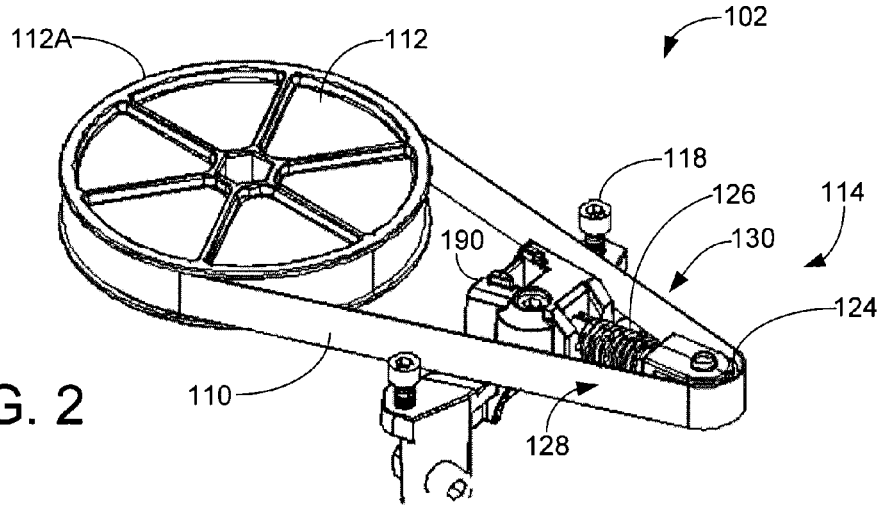
FIG. 2 shows the sharpener assembly attachment of FIGS. 1A-1B with a guide housing of the assembly removed.

FIG. 2 shows relevant portions of the assembly 102 without the guide housing 116, which can remain in place or be removed as desired, depending on the style of tool and type of sharpening operation desired by the user. Generally, it will be noted from FIG. 2 that the tensioner assembly 114 includes a distal roller 124, so that the belt 110 is routed around the pulley 112 and the roller 124. This arrangement desirably forms a generally triangular path for the belt.

A biasing member 126 characterized as a coiled spring provides an outwardly directed bias force upon the roller 124, which maintains a desired level of tension in the belt 110 during operation. The relative diameter of the pulley 112 establishes a desired linear speed for the belt in relation to the operational speed of the unit drive assembly. Other arrangements can readily be used, however, including arrangements with three (or more) rollers, arrangements that provide non-triangular paths for the belt, etc.

The generally triangular arrangement of the belt 110 as shown in FIG. 2 advantageously provides a pair of opposing elongated extents of the belt, denoted generally at 128 and 130, respectively, adapted to receive presentation of the tool thereagainst. Sufficient clearance is available behind the belt at these extents 128, 130 to allow desired inward deflection of the belt by the tool, as explained below.

Figure 3A:
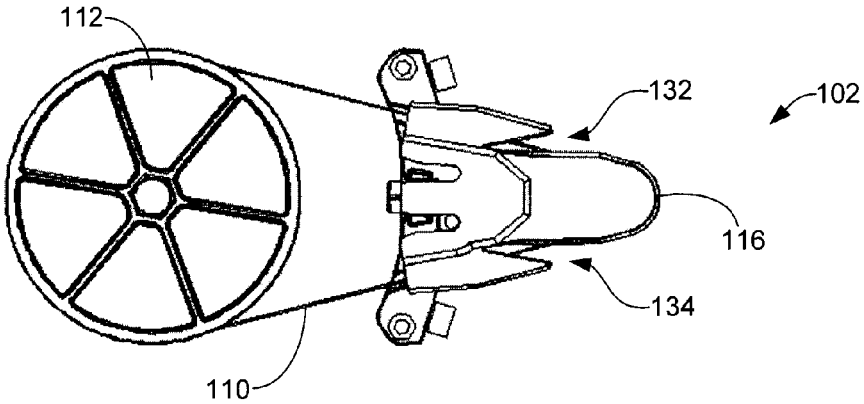
FIG. 3A is a top plan view of the attachment of FIG. 2 with the guide housing in place.
Figure 3B:
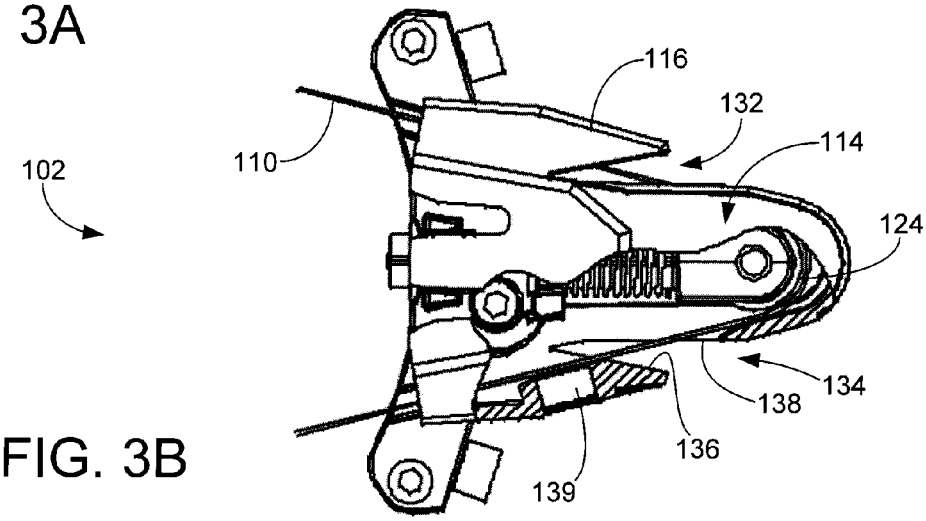
FIG. 3B shows the guide housing in partial cutaway fashion.

FIGS. 3A and 3B provide corresponding top plan views of the assembly 102 with the guide housing 116 installed. For reference, FIG. 3A shows the guide housing 116 in its entirety, whereas FIG. 3B shows the guide housing 116 in a partial cutaway fashion.

The guide housing 116 is preferably formed of a suitable rigid and protective material, such as injection molded plastic, and includes opposing sharpening guides 132, 134. The guides 132, 134 enable an elongated bladed cutting tool, such as a kitchen knife, to be alternately presented to the respective extents 128, 130 of the belt 106 (FIG. 2) in a controlled fashion.

As shown in FIG. 3B, each of the guides 132, 134 are characterized as forming a substantially v-shaped slot with opposing guide surfaces 136, 138. During a sharpening operation, the tool is inserted into a selected slot 132, 134 and contactingly moved along the guide surface 136, thereby causing the tool to be drawn across the belt 110.

This is preferably repeated a number of times in succession (such as 3-5 times), after which the tool is moved to the other guide and the process is repeated. Magnets 139 (see also FIG. 1) are preferably incorporated into each of the guides 132, 134 to serve as a suitable retention feature to maintain the tool in contacting abutment with each the respective guide surfaces 136.

Figure 4A:
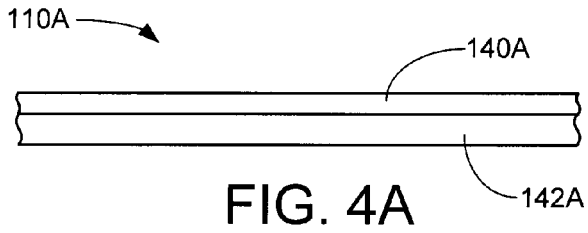
FIGS. 4A and 4B show respective side views of exemplary first and second abrasive belts.
Figure 4B:
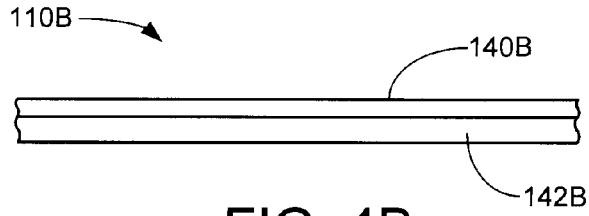

FIGS. 4A and 4B show different constructions for belts suitable for use with the assembly 102. FIG. 4A shows a preferred construction of an exemplary first belt 110A which includes a layer of abrasive material 140A affixed to a backing (substrate) layer 142A. The abrasive layer can take any number of forms, such but not limited to diamond particles, sandpaper material, etc., and will have a selected abrasiveness level (roughness).

In the present example, the first belt 110A is contemplated as having an abrasiveness level on the order of about 400 grit. It is contemplated that the relative stiffness and roughness of the first belt 110A will make the belt suitable for initial grinding operations upon a cutting tool in which relatively large amounts of material are removed from the tool.

FIG. 4B shows an exemplary second belt 110B that can be installed onto the assembly 102 in lieu of or after the use of the first belt 110A. The second belt 110B also has an abrasive layer 140B and a backing layer 142B. The abrasive layer 140B is contemplated as comprising a finer grit than that of the first belt 110A, such as order of about 1200 grit. The second belt 110B is thinner than the first belt 110A, and is contemplated as being generally more flexible than the first belt 116A.

The second belt 110B is particularly suited for finer grinding or honing operations upon the cutting tool in which relatively smaller amounts of material are removed from the tool. Any number of belts can be provided with different levels of abrasiveness, including belts with a grit of 40 or lower, belts with a grit of 2000 or higher, etc.

Figure 5A:
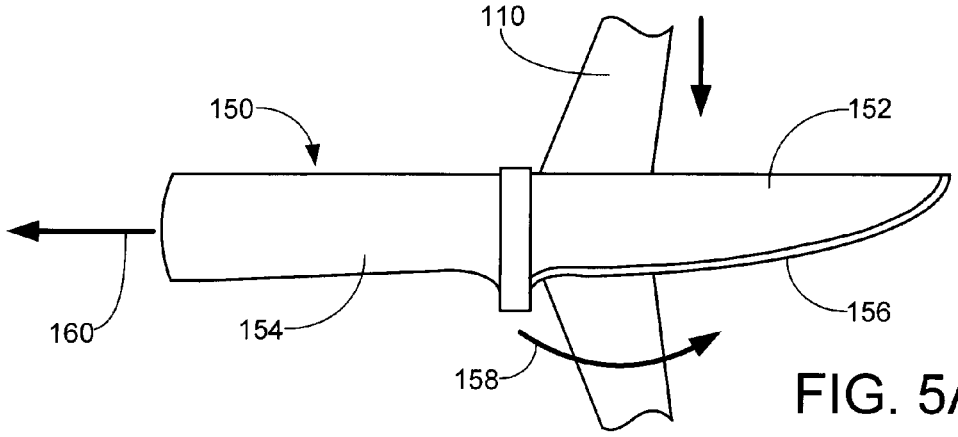
FIGS. 5A and 5B generally illustrate different torsion effects that may be encountered by the abrasive belt in accordance with various embodiments.

FIG. 5A shows a selected belt 110 in conjunction with an exemplary tool 150 characterized as a conventional kitchen knife. The knife 150 includes a blade 152 and a user handle 154. The blade 152 has a cutting edge 156 which extends in a curvilinear fashion as shown. As will be appreciated, the cutting edge 156 is formed along the intersection of opposing sides of the blade which taper to meet at the edge 156.

As shown in FIG. 5A, when the base of the blade 152 is presented against the abrasive layer of the belt 110, the belt twists out of its normally aligned plane, as indicated by torsion arrow 158, and follows the contour of the cutting edge 156. More specifically, the user preferably grasps the handle 154, places the blade 152 in a selected one of the guides 132 or 134, and pulls the knife 150 back in a substantially linear fashion as indicated by arrow 160. In doing so, the moving belt 110 will undergo localized torsion (twisting) to maintain a constant angle of the abrasive layer against the blade 152 irrespective of the specific shape of the cutting edge 156. In this way, a constant and consistent grinding plane can be maintained with respect to the blade material.

The amount of torsional displacement can vary widely. A typical amount of twisting may be on the order of 30 degrees or more out of plane. Stiffer belts may twist very little (such as on the order of 5-10 degrees or so out of plane). In extreme cases such as when the distal tip of a blade passes across the belt, twisting of up to around 90 degrees or more out of plane may be experienced.

The direction of belt twist will also be influenced by the relation of the cutting edge 156 to the belt 110. In FIG. 5A, a portion of the cutting edge 156 at the base of the blade 152 adjacent the handle 154 is generally concave with respect to the belt 110. This will generally induce torsion in a counterclockwise direction, as indicated by the arrow 158, as that portion of the blade passes adjacent the belt 110.

Figure 5B:
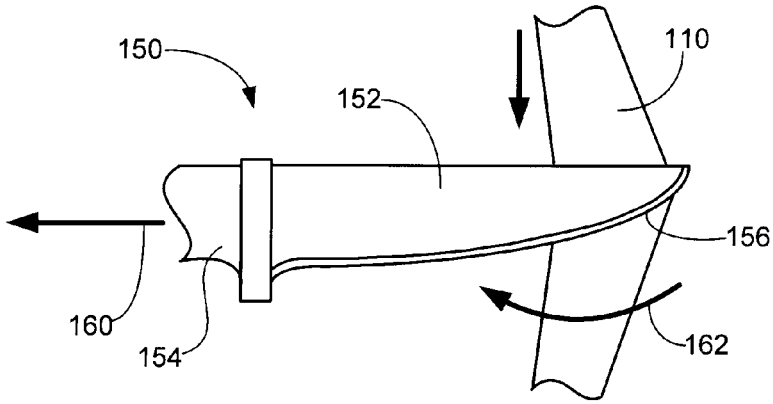

In FIG. 5B, a second portion of the cutting edge 156 near the point of the blade 152 is generally convex with respect to the belt 110. Passage of this portion adjacent the belt will generally induce torsion in the opposite clockwise direction, as indicated by arrow 162.

Figure 6A:
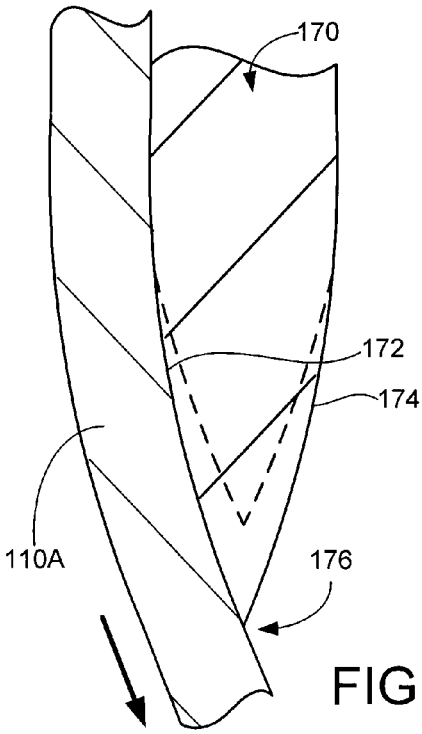
FIGS. 6A and 6B generally depict a progression of symmetrical sharpening operations that may be advantageously performed upon a cutting tool to provide the tool with a desired final geometry.
Figure 6B:
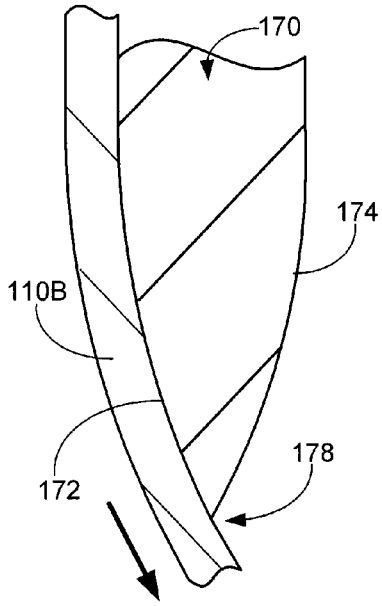

FIGS. 6A and 6B generally illustrate a preferred sharpening sequence upon an exemplary blade 170. As will be recognized by those skilled in the art, the ability to obtain a superior sharpness for a given cutting tool will depend on a number of factors, including the type of material from which the tool is made. It has been found that certain types of processed steel, such as high grade, high carbon stainless steel, are particularly suitable to obtaining sharp and strong cutting edges.

FIG. 6A shows the blade 170 during sharpening with a first belt (such as the exemplary belt 110A of FIG. 4A). This results in a relatively coarse grind upon the blade material, and provides a relatively large radius of curvature upon opposing sides 172, 174 of the blade 170 due to the relatively higher stiffness of the belt 110A. The operation of FIG. 6A produces a first cutting edge 176 at the junction of sides 172, 174.

It is contemplated that the sharpening operation depicted in FIG. 6A is applied to both sides 172, 174 of the blade 172 using the respective guides 132, 134 in turn. At the conclusion of this first stage of the sharpening operation, the first belt 110A is removed from the sharpener assembly 102 and a second belt (such as 110B) is installed, as shown in FIG. 6B. This second stage of the sharpening operation provides a relatively fine (honing) grind, and results in a correspondingly smaller radius of curvature upon the surfaces 172, 174 due to the greater flexibility of the second belt 110B.

The smaller radius of curvature established by the more flexible second belt generally localizes the honing operation to the vicinity of the end of the blade 170. This produces a new cutting edge 178 by the removal of material in FIG. 6B over what was present in FIG. 6A.

Figure 7:
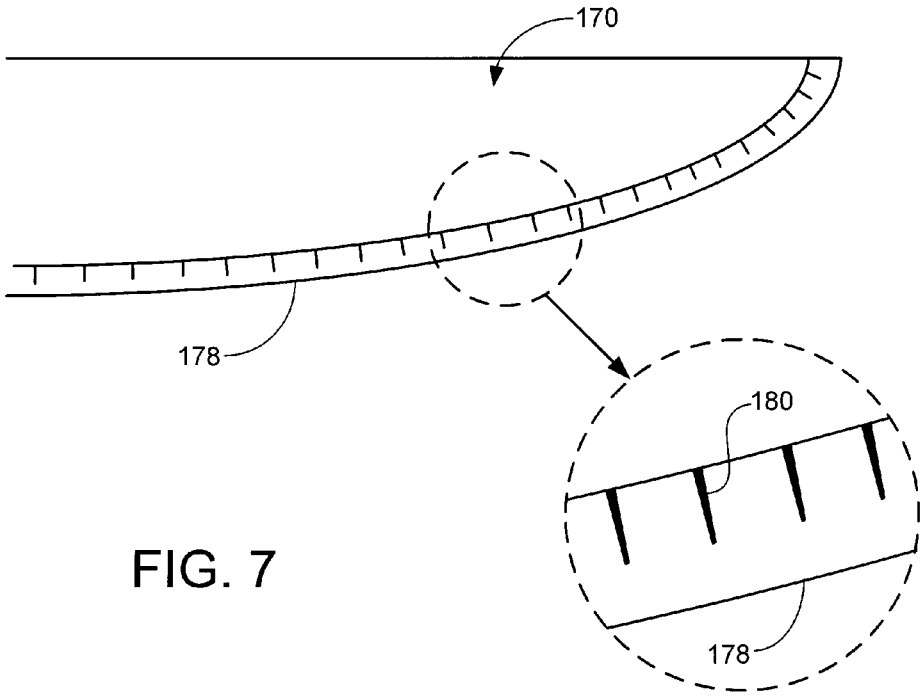
FIG. 7 is a side view representation of the results of the sharpening sequence of FIGS. 6A-6B.

FIG. 7 shows a side view depiction of the blade 170 at the conclusion of the secondary sharpening operation of FIG. 6B. Generally, score (scratch) marks 180 may be present on the blade as a result of the relatively more aggressive abrasive of the first belt 110A. The ends of these score marks 180, however, may be honed out of the blade in the vicinity of the final cutting edge 178 as a result of the secondary sharpening operation.

While two belts have been discussed above, it will be appreciated that such is merely illustrative and not limiting. For example, sharpening can be accomplished using any number of belts of various abrasiveness and stiffness that are successively installed onto the assembly 102 and utilized in turn. Conversely, sharpening operations can be effectively carried out using just a single belt of selected abrasiveness and stiffness.

Figure 8:
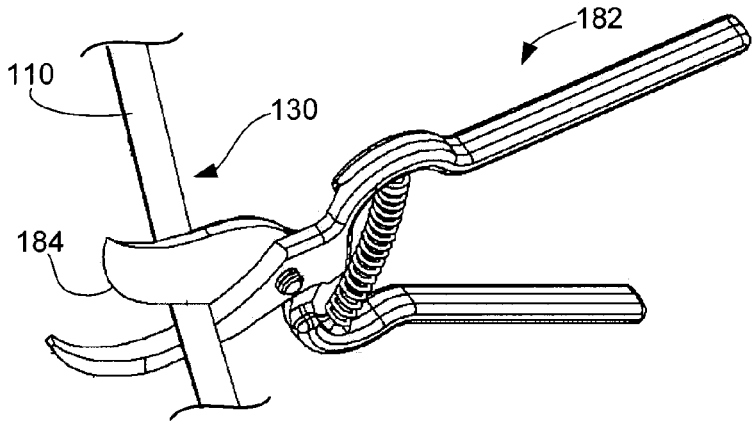
FIG. 8 depicts a sharpening operation using a cutting tool onto a selected extent of the belt without guide housing in place.

Tools that cannot be easily accommodated in the guides 132, 134 can be readily sharpened in similar fashion simply by removing the guide housing 116 and presenting the tool to the exposed extents 128, 130 of the belt 110. An exemplary pair of pruning shears 182 is shown in FIG. 8 with a cutting edge 184 sharpened in this way. As before, the shears 182 can be sharpened successively using different belts in turn, or can be sharpened using a single belt as desired.

It is noted that due to the torsional characteristics of the belt 110, the shears 182 can be easily and effectively sharpened without need to disassemble the shears to allow separate presentation of the cutting edge 184. Accordingly, any number of other styles and types of cutting tools, such as lawn mower blades, machetes, hunting knives, scissors, swords, etc. can be effectively sharpened by the assembly 102 in like manner.

Figure 9:
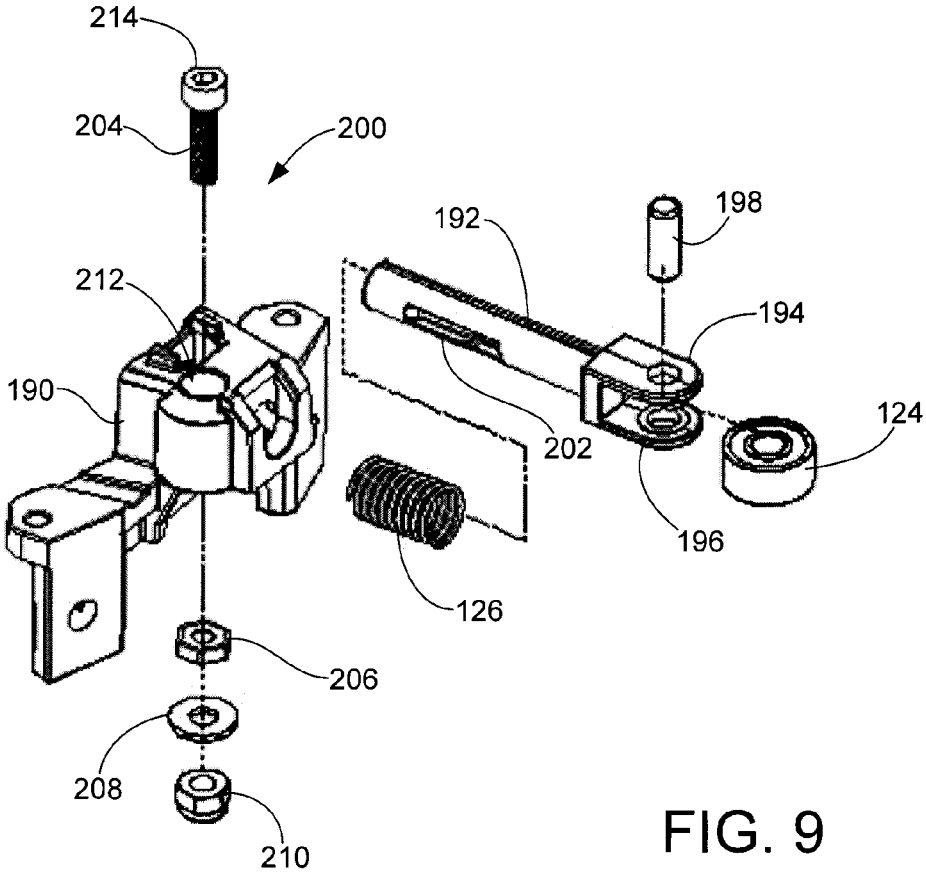
FIG. 9 is an exploded representation of the tensioner assembly of the sharpener assembly attachment.

An exploded view of the tension assembly 114 is set forth by FIG. 9. As noted above, the tension assembly 114 operates to apply a desired about of tension force to the belt 110 during operation, thereby facilitating the requisite twisting of the belt in a controlled manner. The tension assembly 114 provides a number of other advantages as well, such as tracking adjustment capabilities and locking features to facilitate ease of belt replacement.

The tension assembly 114 includes a base member 190 configured to be contactingly mounted to the housing 108 of the underlying unit 104. As desired, the fasteners 118 (FIG. 1) used to secure the base member 190 can be preferably advanced or retracted to adjust the alignment of the base member 190, and hence the alignment of the roller 124, relative to the pulley 112 to ensure proper tracking of the belt. Guide flanges 112A (see FIGS. 2 and 3A) are preferably provisioned on the pulley 112 to retain the belt 110 thereon. Crowns can be provided to the pulley 112 and/or the roller 124 to further ensure desired tracking of the belt.

A retractable support shaft 192 extends from the base member 190. Opposing flanges 194, 196 are provided at a distal end of the shaft 192 to support a stationary roller shaft 198 about which the roller 124 freely rotates. The biasing spring 126 surrounds the shaft 192 and exerts a biasing force between the shaft 192 and the base member 190.

A novel locking and tracking arrangement for the shaft 192 is achieved using a fastener assembly 200, which cooperates with an elongated slot (groove) 202 in the shaft 192. The fastener assembly 200 includes a threaded fastener 204, a nut 206, a washer 208 and a capture nut 210. The nut 206 is configured to freely advance along the threads of the fastener 204, and the capture nut 210 is configured to lockingly engage the threads at the end of the fastener 204.

Figure 10:
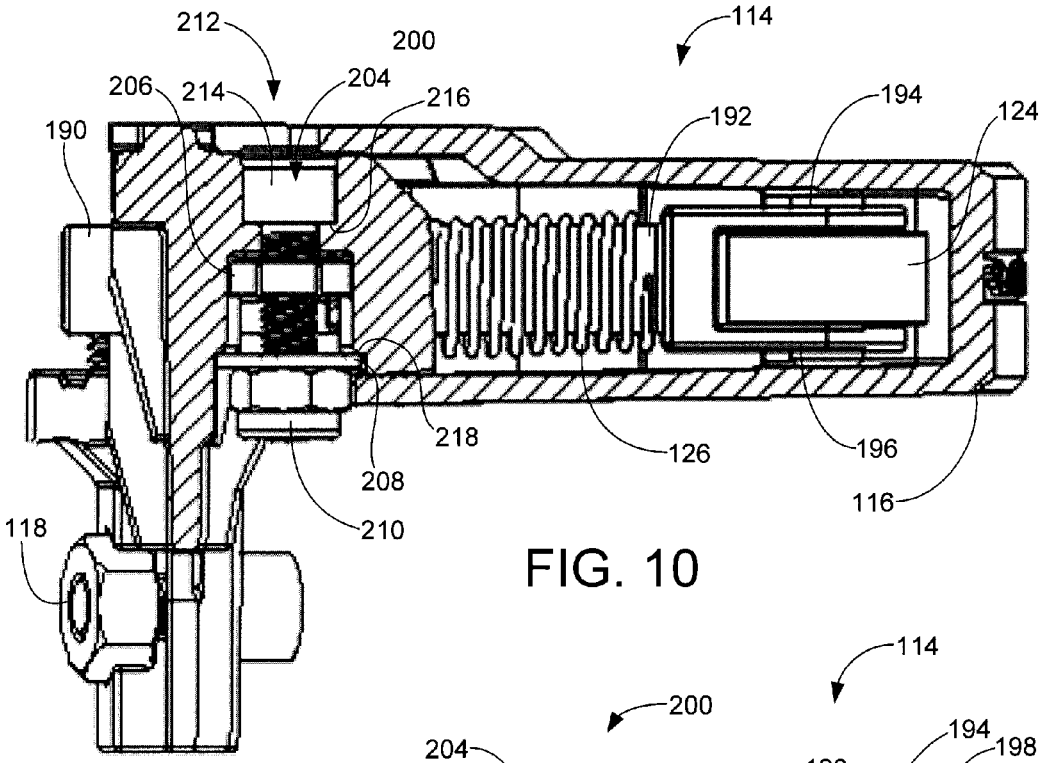
FIG. 10 is an elevational, cross-sectional representation of the tensioner assembly.

The fastener assembly 200 is installed into a recess 212 in the base member 190. As shown in FIG. 10, the nut 206 is disposed along a medial portion of the threads of the fastener 204. A head 214 of the fastener 204 abuts a recessed shoulder surface 216 within the recess 212, and the washer 208 abuts an opposing recessed shoulder surface 218 with the recess 212. The capture nut 210 maintains the fastener assembly 200 in this configuration.

Figure 11A:
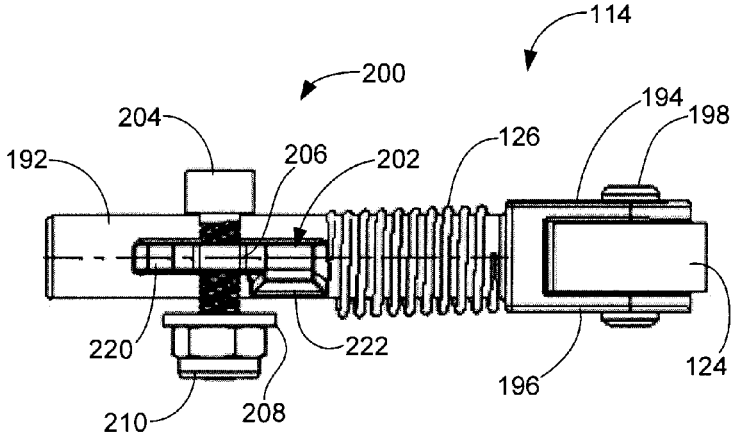
FIGS. 11A and 11B show the tensioner in respective extended and retracted (locked) positions.
Figure 11B:
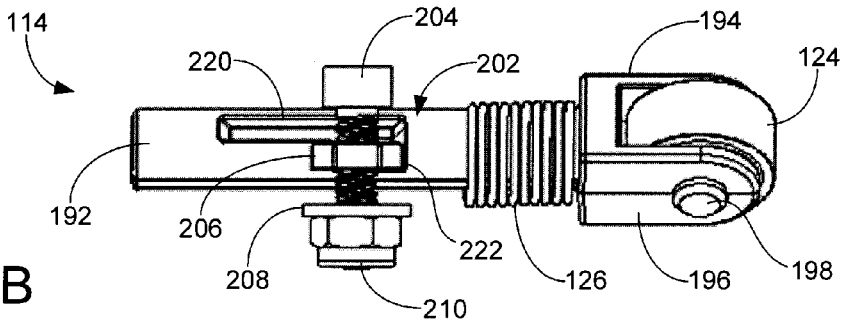

The nut 206 (also referred to herein as a guide member) is selectively advanced along the threads of the fastener 204 so as to be aligned with and partially extend into the groove 202 in the shaft 192. As shown in FIGS. 11A and 11B, the groove 202 is generally L-shaped, with an elongated portion 220 which extends along an axial length of the shaft 192, and an offset portion 222 which extends circumferentially around the shaft 192. Both the elongated portion 220 and the offset portion 222 of the L-shaped groove 202 are sized to accommodate the nut 206 on the fastener 204.

The shaft 192 (and hence, the roller 124) is selectively moveable between an extended position (FIG. 11A) and a retracted position (FIG. 11B). In the extended position, the nut 206 lies along a medial extent of the elongated portion 220 of the groove. This is the position during normal operation of the assembly 102. The spring 126 advances the shaft 192 outwardly (e.g., away from the roller 112) and this outward movement is bounded by the tension in the belt 110.

The shaft 192 can be moved inwardly and outwardly during operation (such as via deflection of the belt 110), which results in relative sliding movement of the nut 206 along the elongated portion 220 of the groove 202. The nut 206 maintains the shaft 192 in a consistent angular orientation during such displacement.

The shaft 192 is further moved to the retracted position by the application of force by the user thereon to overcome the spring force, thereby inducing relative movement of the nut 206 along the groove 202 to the offset portion 222. The shaft 192 is next rotated to advance the nut 206 into the offset portion 222 of the groove 202, as shown in FIG. 11B. This locks the shaft 192 in the retracted position, since the nut 206 will bear against the interior sidewall of the offset portion 222 of the groove 202 and prevent axial movement of the shaft 192 from the bias force of the spring 126.

This locking capability allows the user to easily retract and lock in place the shaft 192 and roller 124, allowing an existing belt 110 to be removed and a new replacement belt to be installed. To place the shaft 192 back in the normal extended operation, the shaft 192 is simply rotated to place the nut 206 back into alignment with the elongated portion 220 of the groove 202. This allows the spring 126 to advance the shaft 192 and the roller 124 to engage the interior of the belt 110.

The fastener assembly 200 further advantageously operates to provide axial tracking adjustment capabilities for the sharpener assembly 102. As noted above, the nut 206 is disposed so as to extend into the elongated portion 220 of the groove 202 during normal operation with the roller 124 in the extended position. With reference again to FIGS. 10 and 11A, rotation of the fastener 204 can be effected by engaging the head 214 of the fastener 204 with a suitable mating tool, such as a screwdriver or hex driver.

Because of the captured nature of the fastener 204 within the recess 212 of the base member 190, such rotation of the fastener 204 will not axially advance or retract the relative elevational location of the fastener 204 within the recess; rather, the fastener 204 will merely rotate in place. However, due to the threaded coupling of the nut 206 with the threads along the fastener 204, such rotation will operate to axially move the nut 206 along the fastener 204, either toward or away from the fastener head 214 depending on the direction of rotation of the fastener 204.

This axial movement of the nut 206 will correspondingly induce an axial rotation of the shaft 192 along its axis, thereby changing the angle of the roller 124 and hence, the tracking of the belt 110. This provides an efficient worm gear arrangement that enables the user to adjust the path of the belt 110 so as to be properly aligned around the roller 124 and the drive roller 112. The tensioner assembly 114 thus provides an integrated tracking and locking mechanism for the roller 124.

Figure 12:
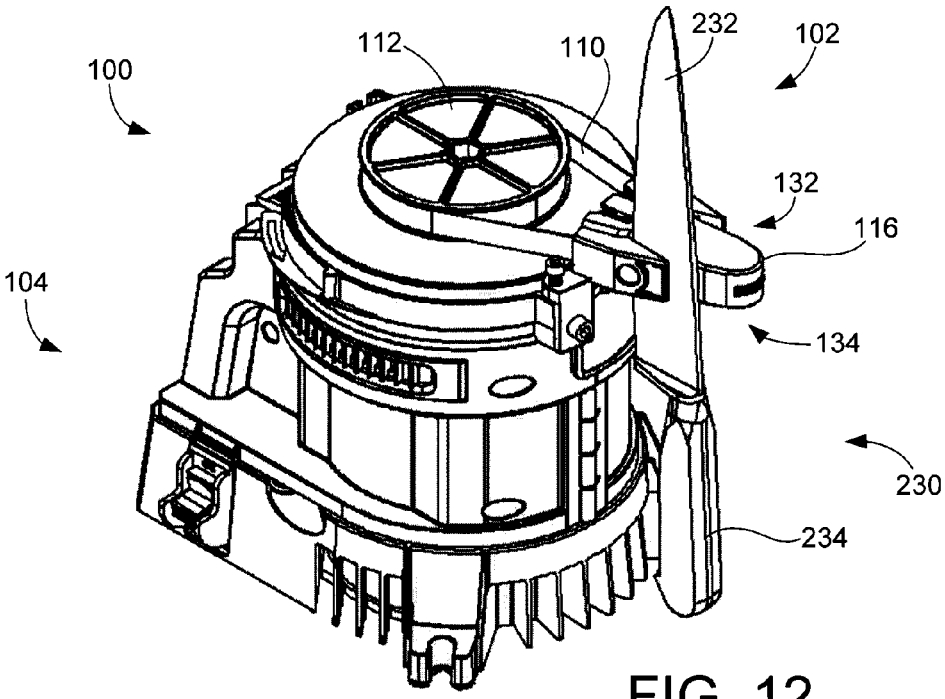
FIG. 12 shows the view of the sharpener previously provided in FIG. 1A in conjunction with a cutting tool presented for sharpening.

FIG. 12 shows the system 100 of FIG. 1A in conjunction with another cutting tool 230 characterized as a conventional kitchen knife with blade 232 and handle 234. The blade 232 is preferably formed of a metallic, magnetically permeable material such as stainless steel, although such is not limiting. FIG. 12 shows a preferred orientation of the knife 230 as it is presented for sharpening to the guide 134.

Preferably, the user grasps the handle 234, orients the knife 230 in a substantially vertical orientation, inserts the blade 232 into the guide knife 134 so that a base portion of the blade 232 adjacent the handle 234 is placed into the guide, and draws the knife 230 downwardly through the guide along a linear path. It will be appreciated that other relative orientations of the sharpener assembly 102 and the knife 230 (or other tools) can be readily used as desired. For example, the knife 230 in FIG. 12 can be alternatively sharpened by turning the knife over and drawing the knife upwardly through the guide 134. The foregoing similarly applies to the use of the other guide 132.

Figure 13A:
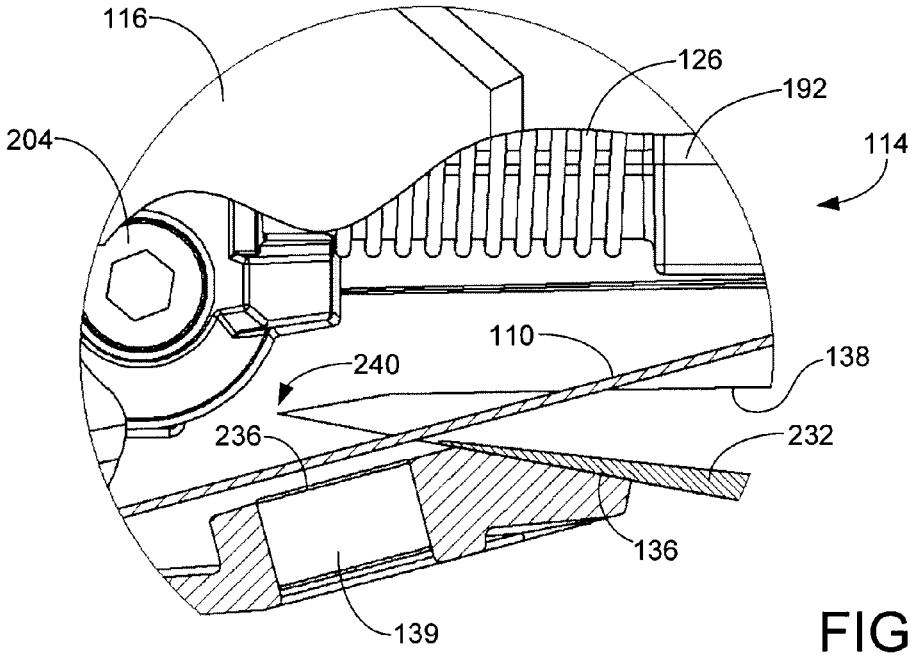
FIGS. 13A-13C show respective partial cross-sectional views of the guide housing and the cutting tool of FIG. 12 to show successive levels of advancement of the cutting tool during preferred sharpening sequences.
Figure 13B:
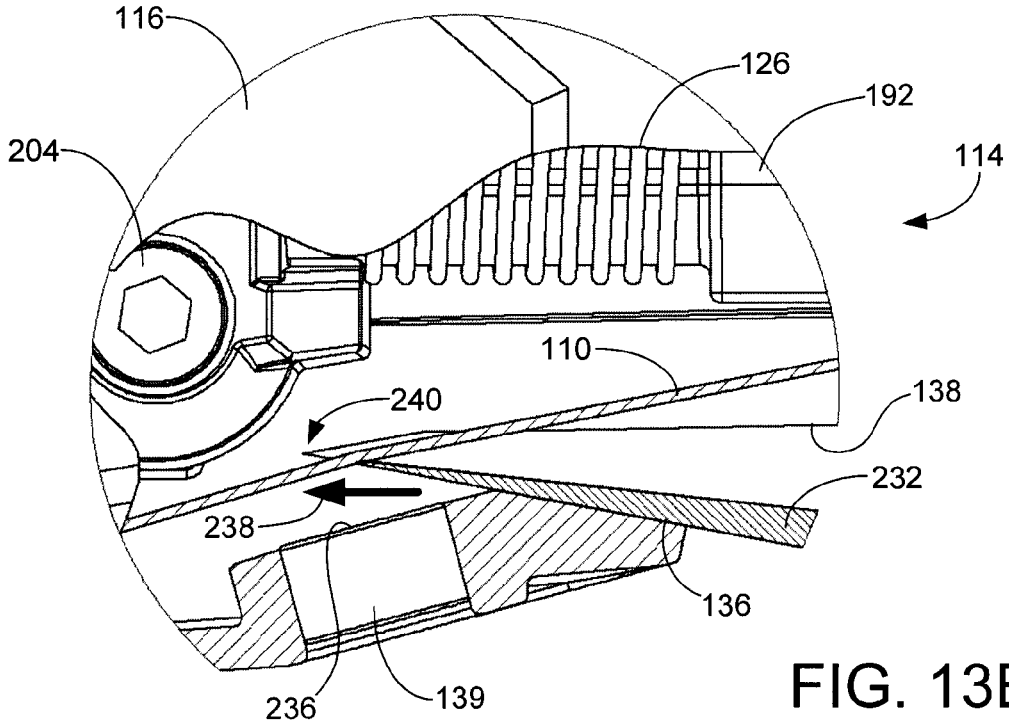
Figure 13C:
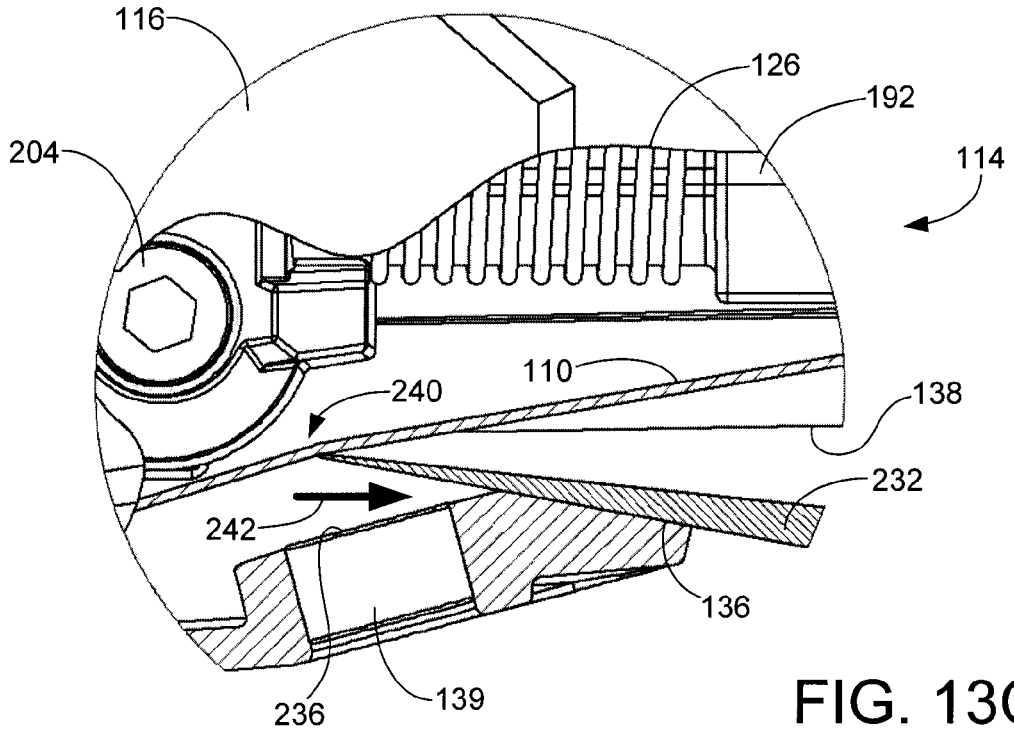

FIGS. 13A-13C provide cross-sectional views of the guide housing 116 and the tensioner assembly 114 in conjunction with the knife 230 of FIG. 12 to illustrate various aspects of the foregoing sharpening operation. FIG. 13A shows the knife during an initial insertion of the blade 232 into the guide 134. Due to the metallic nature of the blade 232, the magnet 139 in the guide housing 116 will generally operate to draw the blade 232 against and along the guide surface 136, thereby helping to ensure the desired presentation of the blade 232 to the belt 110.

FIG. 13B shows a subsequent view of the arrangement of FIG. 13A in which the blade 232 has continued to advance into the guide 134 along the surface 136 as a result of the magnetic attraction provided by the magnet 139. It will be noted that the orientation of FIG. 13B represents a neutral, or steady-state condition in that the force applied to the blade 232 by the magnet 139 is sufficient to maintain the knife 230 in this orientation within the guide, even in the absence of support of the knife 230 by the user as depicted in FIG. 12.

This neutral position is selected to place the blade 232 into contacting engagement with the abrasive surface of the belt 110 to induce the aforementioned torsional and bending mode deflection thereof, as discussed above. Hence, all that is needed to carry out the aforementioned sharpening operation is for the user to exert a relatively small downward force upon the handle 234 to draw the blade 232 through the guide 134.

At this point it will be noted that the magnet 139 is canted (skewed) with respect to the surface 136. Such is preferred but not necessarily required; for example, the same neutral position could be achieved if a top pole surface 236 of the magnet 136 were aligned within the guide housing 116 so as to be substantially parallel with the guide surface 136.

Regardless, it is preferred that the magnet 139 be placed at sufficient "depth" along the guide 134 such that the magnet 139 is both drawn along and into the guide. That is, the magnet 139 does not merely exert a biasing force upon the blade 232 so as to hold the blade against the surface 136, but rather serves to exert a vector force, as generally depicted by arrow 238, that both draws the blade against the surface 136 and feeds the blade into contacting engagement with and deflection of the belt 110.

FIG. 13C shows an alternative placement of the blade 232 into the guide 134. In FIG. 13C, it is contemplated that the user has applied an insertion force upon the blade 232 via handle 234 so that the blade 232 has advanced fully into the guide 134 past the neutral position of FIG. 13C. That is, the user has applied an inwardly directed force such that a portion of the cutting edge of the blade 232 contactingly engages a v-shaped distal extent 240 (best viewed in FIG. 13A) of the guide 134 at the distal ends of opposing guide surfaces 136 and 138. This distal extent 240 serves as an ultimate limit stop for further insertion of the blade 232.

Because the blade 232 has been advanced by the user beyond the neutral position of FIG. 13B, the magnet 139 exerts a corresponding force (shown by arrow 242) that would otherwise urge the blade 232 back to the neutral position. It will be appreciated that the blade 232 can be readily sharpened using either the insertion configuration of FIG. 13B or 13C, so long as the same insertion configuration is utilized by the user during each pass of the blade 232 through the guide.

In view of the foregoing, it will now be appreciated that various embodiments of the present invention provide a number of advantages over the prior art. The sharpening assembly 102 provides an effective belt-based sharpening solution that facilitates very precise and repeatable sharpening of a wide variety of tools to levels approaching and even exceeding so-called "razor" sharpness.

The use of a guide housing with one or more sharpening guides facilitates the ability to sharpen elongated, bladed tools, such as kitchen knives, with straight or curvilinearly extending cutting edges in a fast and efficient manner. The preferred removeability of the guide housing further allows a large number and variety of tools to be presented to linear extents of the belt with sufficient clearance for sharpening operations thereon.

Any number of different styles of belts with different thicknesses, stiffnesses and abrasiveness levels can be successively utilized to achieve sharpening of cutting edges. It has been found that a variety of tools, including ceramic knives, can be readily sharpened in a consistent manner. The novel tensioner assembly disclosed herein provides an efficient and easy to use a locking feature that allows belts to be easily replaced as desired.

Finally, while preferred embodiments disclosed herein utilize one or more abrasive belts to carry out a sharpening operation, it will be appreciated that such is illustrative and not limiting. For example, the disclosed tensioner assembly can readily be used for locking and/or tracking adjustments of other types of belts, not necessarily abrasive belts in the environment of a sharpening operation. Similarly, the disclosed guide housing can readily be adapted to hold a cutting tool at a neutral position so that the cutting tool exerts a contacting force against other types of abrasive media besides the belts disclosed herein, such as an abrasive disc, etc.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. A sharpening apparatus comprising:

an endless abrasive belt advanced along a belt path;

a roller positioned along the belt path; and a tensioner assembly which applies a biasing force to the roller to maintain a selected tension in the belt and to facilitate translational displacement of the roller during deflection of the belt as a tool is presented against the belt to sharpen a cutting edge thereof as the belt advances along the belt path, wherein the tensioner assembly comprises:

a base member;

a shaft moveable with respect to the base member and having an outer surface into which extends an L-shaped groove with an elongated portion and an offset portion, the shaft having opposing proximal and distal ends, the distal end supporting the roller;

a biasing member disposed between the shaft and the base member to apply said biasing force to the roller; and a guide member secured in a stationary position with respect to the base member and extending into the groove, wherein in an extended position the guide member slidingly advances along the elongated portion of the L-shaped groove relative to the shaft to facilitate said translational displacement of the roller during said deflection of the belt, and wherein the roller is moved to a locked retracted position to facilitate replacement of the belt by sliding movement of the guide member relative to the shaft and angular rotation of the shaft to place the guide member within the offset portion.

2. The apparatus of claim 1, wherein the shaft extends in a first direction, wherein the guide member comprises a nut disposed onto a threaded fastener extending in a second direction normal to the first direction, and wherein a portion of the nut extends into the L-shaped groove.

3. The apparatus of claim 2, wherein the biasing member comprises a spring member which exerts the biasing force between the shaft and the base member.

4. The apparatus of claim 2, wherein the nut engages threads of the threaded fastener, and wherein rotation of the fastener within the base member induces advancement of the nut along said threads and rotation of the shaft relative to the housing member to adjust a tracking alignment of the belt on the roller.

5. The apparatus of claim 1, wherein the biasing member is a coiled spring having a first end which engages the shaft and a second end which engages the base member.

6. The apparatus of claim 1, further comprising a drive pulley rotated at a selected rotational rate, wherein the belt is routed around the drive pulley and the roller to move along a corresponding selected linear speed.

7. The apparatus of claim 1, wherein the tensioner facilitates torsional conformance of the belt against the cutting edge of the tool during sharpening thereof.

8. The apparatus of claim 7, further comprising a removeable guide housing comprising a guide slot to facilitate presentation of the tool against the belt for sharpening thereon, and wherein the guide housing is removable to facilitate presentation of a second tool to said extent of the belt for sharpening thereon.

9. The apparatus of claim 8, wherein sufficient clearance is provided behind the belt opposite an abrasive surface thereof so that as a cutting edge of a second tool is presented against the abrasive surface, another portion of the second tool extends behind the belt.

10. The apparatus of claim 1, further comprising a drive motor assembly which contactingly engages the belt to advance the belt along the belt path.

11. A sharpening apparatus comprising:

an endless abrasive belt configured for rotational advancement along a belt path;

a roller which supports the belt as the belt rotationally advances along the belt path; and a tool guide surface adjacent a planar extent of the belt path adjacent the roller; and a tensioner assembly which applies a biasing force to the roller to maintain a selected tension in the belt and to facilitate translational displacement of the roller during deflection of the belt induced by presentation of a side of a cutting tool against the tool guide surface and a cutting edge of the tool against the belt, wherein the tensioner assembly comprises:

a base member;

a shaft comprising an outer surface with an elongated groove extending therein, the shaft rotatable about a central axis which extends in a first direction along an axial length of the shaft, the shaft having a proximal end supported by the base member and a distal end configured to support the roller;

a biasing member disposed between the shaft and the base member to apply said biasing force to the roller; and a guide member supported by the base member and partially extending into the elongated groove, wherein advancement of the guide member in a second direction normal to the first direction induces axial rotation of the shaft about the central axis to adjust a tracking alignment of the belt on the roller.

12. The apparatus of claim 11, wherein the guide member comprises a nut disposed onto a threaded fastener to engage threads thereon, wherein a portion of the nut extends into the elongated groove, and wherein rotation of the threaded fastener operates to advance the nut along said threads of the threaded fastener, thereby inducing said axial rotation of the shaft.

13. The apparatus of claim 11, further comprising a drive pulley rotated at a selected rotational rate, wherein the belt is routed around the drive pulley and the roller to move along a corresponding selected linear speed, and wherein the tracking alignment of the belt on the roller serves to align the belt along the roller and the drive pulley.

14. The apparatus of claim 11, wherein the tensioner facilitates torsional conformance of the belt against the presented tool.

15. The apparatus of claim 11, wherein the tool guide surface forms a portion of a guide slot in a removeable guide housing, the guide slot facilitating presentation of a first tool to an adjacent extent of the belt for sharpening thereon, and wherein the guide housing is removable to facilitate presentation of a second tool to said extent of the belt for sharpening thereon.

16. The apparatus of claim 15, wherein sufficient clearance is provided behind the belt opposite an abrasive surface thereof so that as a cutting edge of the second tool is presented against the abrasive surface, another portion of the second tool extends behind the belt.

17. The apparatus of claim 12, wherein the guide housing comprises a magnet disposed adjacent the guide slot to exert a biasing force upon the first tool that both draws the first tool against a guide surface of the guide slot and draws the first tool into the guide slot to a neutral position at which a cutting edge of the first tool comes into contacting engagement with the belt.

18. The apparatus of claim 11, wherein the elongated groove in the shaft comprises an offset portion so that the elongated groove is characterized as an L-shaped groove, wherein in an extended position the guide member slidingly advances along the elongated portion relative to the shaft to facilitate said displacement of the roller, and wherein the roller is moved to a locked retracted position by sliding movement of the guide member relative to the shaft and angular rotation of the shaft to place the guide member within the offset portion.

19. A sharpening apparatus comprising:

an endless abrasive belt;

a roller adapted to contactingly engage the belt during continuous rotation of the belt about the roller in a selected rotational direction; and a tensioner assembly adapted to maintain a selected tension in the belt during said rotation thereof as a cutting edge of a tool contactingly engages the belt, the tensioner assembly comprising:

a base member;

a shaft moveable with respect to the base member and having a cylindrical outer surface into which extends an elongated groove, the shaft having opposing proximal and distal ends, the distal end supporting the roller;

a biasing member disposed between the shaft and the base member to apply a biasing force to the roller in opposition to said tension in the belt; and a guide member secured in a stationary position with respect to the base member, the guide member comprising a nut threaded onto a threaded fastener connected to the base member, the nut partially extending into the groove, wherein rotation of the threaded fastener induces rotation of the shaft with respect to the base member.

20. The apparatus of claim 19, wherein the elongated groove is characterized as an L-shaped groove with elongated portion aligned with a central axis of the groove and an offset portion which extends from an end of the elongated groove circumferentially bout the central axis, wherein the nut is further configured to secure the shaft in a retracted position by inward depression of the shaft against the biasing member and rotation of the shaft to dispose the nut in the offset portion of the groove.

* * * * *